US007165274B1

(12) United States Patent
Vilhauer

(10) Patent No.: US 7,165,274 B1
(45) Date of Patent: Jan. 23, 2007

(54) SYSTEM FOR REMOVING ODOR

(76) Inventor: Clarence G. Vilhauer, P.O. Box 5093, Alamogordo, NM (US) 88311

( * ) Notice: Subject to any disclaimer, the term of this patent is extended or adjusted under 35 U.S.C. 154(b) by 0 days.

(21) Appl. No.: 11/251,356

(22) Filed: Oct. 14, 2005

(51) Int. Cl.
*E03D 9/04* (2006.01)

(52) U.S. Cl. ..... 4/213; 4/217

(58) Field of Classification Search ..... 4/209 R, 4/211–219, 347–352, 209
See application file for complete search history.

(56) References Cited

U.S. PATENT DOCUMENTS

| | | | | | |
|---|---|---|---|---|---|
| 988,273 | A * | 3/1911 | Levenhagen et al. | ..... | 4/217 |
| 1,894,846 | A * | 1/1933 | Pennoyer | ..... | 4/213 |
| 2,824,313 | A * | 2/1958 | Bulow | ..... | 4/213 |
| 3,416,167 | A * | 12/1968 | Klemme | ..... | 4/217 |
| 3,534,415 | A * | 10/1970 | Huffman | ..... | 4/213 |
| 3,874,008 | A * | 4/1975 | Warnberg | ..... | 4/234 |
| 4,864,664 | A | 9/1989 | Higgins | | |
| 4,882,790 | A * | 11/1989 | Ricard | ..... | 4/213 |
| 5,351,344 | A * | 10/1994 | Phillips | ..... | 4/213 |
| 5,671,484 | A | 9/1997 | Lee, III | | |
| 5,996,131 | A | 12/1999 | Vallair | | |
| 6,167,576 | B1 * | 1/2001 | Sollami | ..... | 4/217 |
| 6,237,163 | B1 * | 5/2001 | Guzzo et al. | ..... | 4/213 |
| 6,260,214 | B1 | 7/2001 | Smith | | |
| 6,449,778 | B1 * | 9/2002 | Franco | ..... | 4/217 |
| 6,637,040 | B1 | 10/2003 | Alba | | |
| 6,760,928 | B1 | 7/2004 | Rodriguez | | |

* cited by examiner

*Primary Examiner*—Huyen Le
(74) *Attorney, Agent, or Firm*—Dale J. Ream

(57) ABSTRACT

A system for removing odorous air from a toilet bowl into a sewer line includes a toilet seat defining a plurality of air inlets spaced apart along a bottom side and an air outlet at a rear side with an internal channel connecting the air inlets and outlet. The system includes an air pump suitable for mounting to a rear of the toilet for connection to the toilet seat with tubing. A pressure sensor on the seat actuates the pump to draw air through the inlets to the pump upon sensing the pressure of a user thereon. Additional tubing extends from the pump through the toilet wax ring for exhausting the air into a sewer line. A check valve on the additional tubing prevents return of sewer gas into the system.

15 Claims, 5 Drawing Sheets

SYSTEM FOR REMOVING ODOR

BACKGROUND OF THE INVENTION

This invention relates generally to odor removing systems and, more particularly, to a system for exhausting air from a toilet bowl into a sewer line.

It is desirable to eliminate or diminish powerful bathroom odors. One common method for conquering bathroom odors is by attempting to overpower the odor with a deodorizing spray or solid element. Another common method is to utilize a wall or ceiling mounted fan to draw odors into a wall or attic.

Along with the methods mentioned above, various other proposals have been made in the prior art for venting odors away from a toilet bowl. While assumably effective for their intended purposes, the previous proposals do not provide an efficient means for drawing odors from a toilet bowl directly into the sewer system with minimal modification to the toilet or other structures.

Therefore, it would be desirable to have a system for exhausting air from a toilet bowl directly into a sewer line. Further, it would be desirable to have such a system that requires minimal modification to the toilet or surrounding structures. Still further, it would be desirable to have a system that is actuated by sensing the weight of a user upon the toilet seat.

SUMMARY OF THE INVENTION

A system for removing odor by exhausting air from a toilet into a sewer line includes a toilet seat with a bottom surface defining an air inlet, an air outlet, and a channel within the seat connecting the air inlet and outlet. The system also includes an air pump having inlet and outlet ports. Tubing connects the seat air outlet to the pump inlet port so that the pump draws air from the seat into the pump inlet port. Additional tubing operatively connects the pump outlet port to a sewer line such that malodorous air drawn into the pump through the toilet seat is directed into the sewer line. A check valve is appropriately mounted to the tubing for preventing sewer gas from retreating to the pump or toilet seat.

Therefore, a general object of this invention is to provide a system for transferring odorous air from a toilet bowl into a sewer line.

Another object of this invention is to provide a system, as aforesaid, is to draw the air from the toilet bowl through a toilet seat using an air pump and from the air pump into the sewer line.

Still another object of this invention is to provide a system, as aforesaid, is to provide tubing from the toilet seat to the pump and from the pump to the sewer line.

Yet another object of this invention is to provide a system, as aforesaid, in which the tubing extends through the toilet's wax ring.

A further object of this invention is to provide a system, as aforesaid, that includes a pressure sensor for actuating the pump upon sensing the weight of a user upon the toilet seat.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
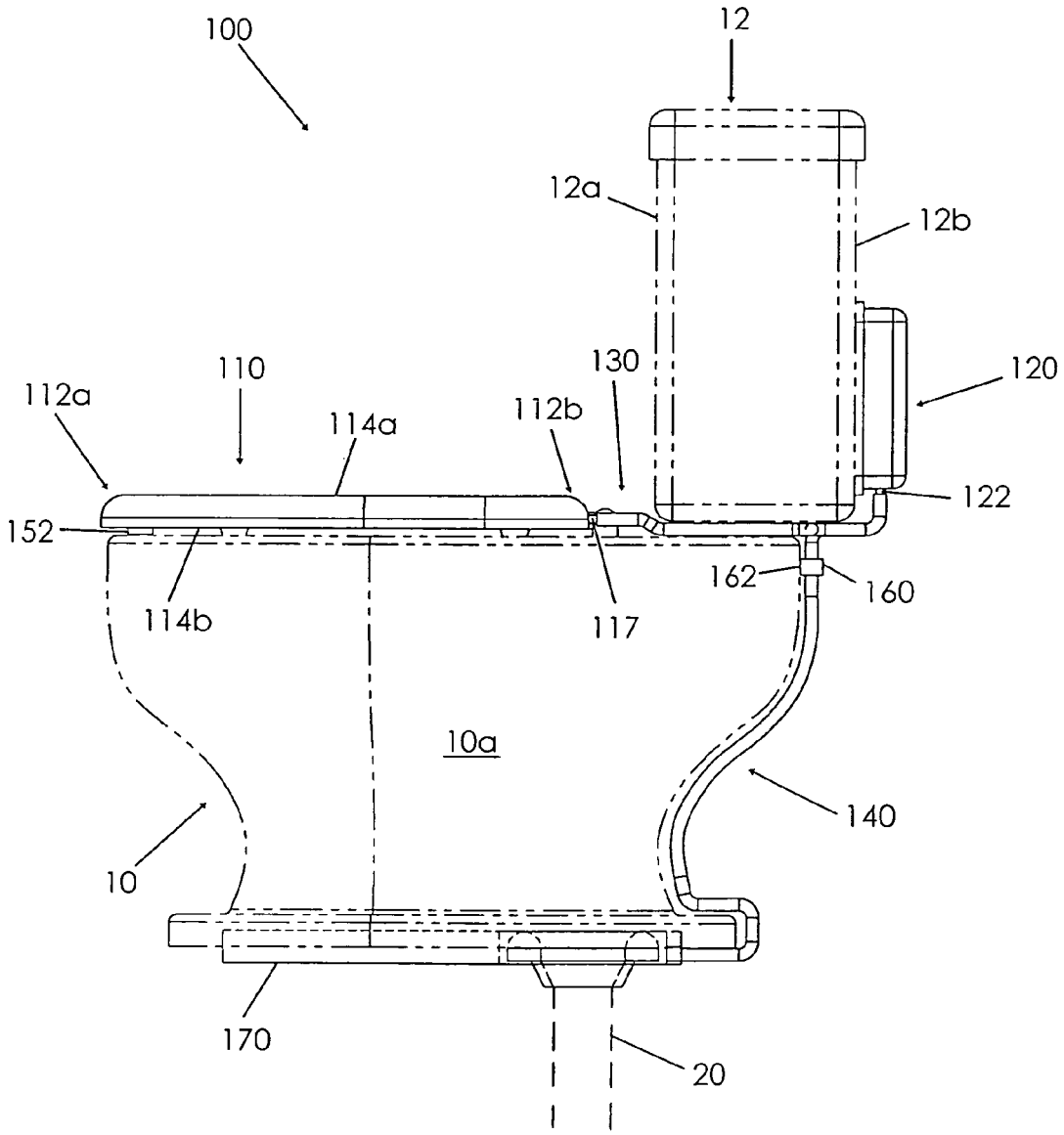
FIG. 1 is a side view of a system for removing odor according to the present invention with the toilet being shown in phantom lines.

A system according to the present invention will now be described in detail with reference to FIGS. 1 through 5*b* of the accompanying drawings. More particularly, a system 100 according to the present invention for removing odor by exhausting air from a toilet 10 into a sewer line 20 includes a toilet seat 110 and an air pump 120.

Figure 4A:
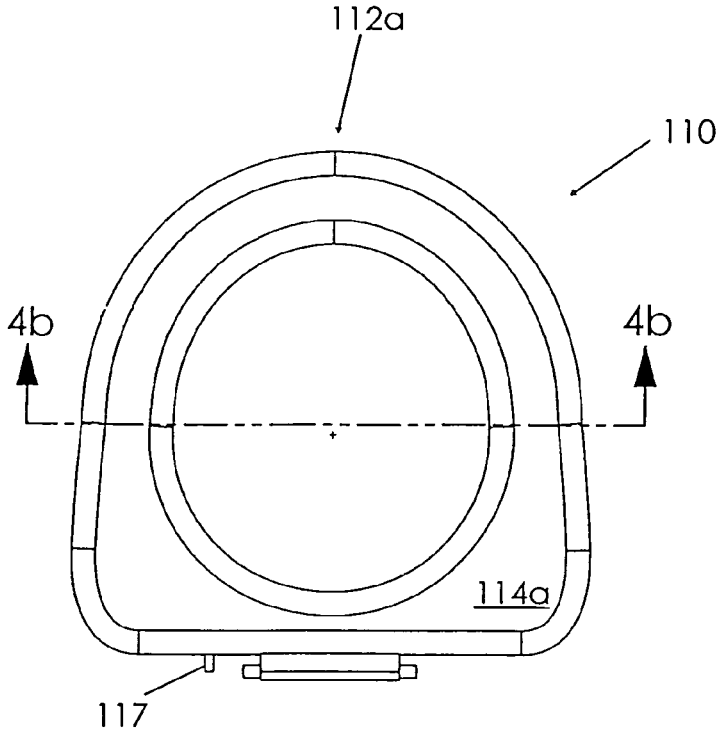
FIG. 4*a* is a top view of the toilet seat removed from the toilet as in FIG. 2.
Figure 4B:
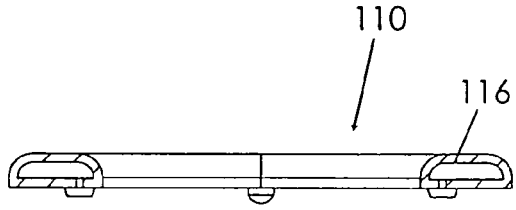
FIG. 4*b* is a sectional view of the toilet seat taken along section 4*b*—4*b* of FIG. 4*a;*
Figure 4C:
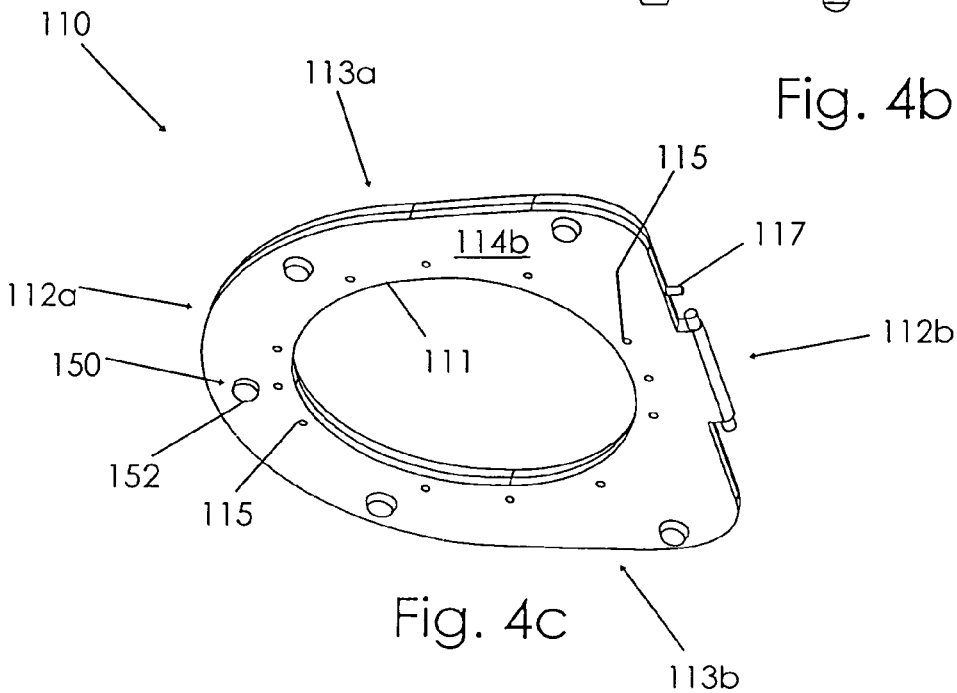
FIG. 4*c* is perspective view of the toilet seat as in FIG. 4*a;*

The toilet seat 110 mounts to the toilet 10 in a traditional manner and presents front and rear sides 112*a*, 112*b*, opposed lateral sides 113*a*, 113*b*, and top and bottom surfaces 114*a*, 114*b*, as can be best seen in FIGS. 4*a* through 4*c*. The bottom surface 114*b* defines at least one air inlet 115, and an air outlet 117 is preferably adjacent the rear side 112*b*. The toilet seat bottom surface 114*b* preferably defines a plurality of air inlets 115 adjacent an inner edge 111 of the seat 110, and the air inlets 115 are preferably concentrated more densely adjacent the front and rear sides 112*a*, 112*b* than adjacent the lateral sides 113*a*, 113*b* because odor is more likely to escape at the front and rear sides 112*a*, 112*b*. A channel 116 between the top and bottom surfaces 114*a*, 114*b* connects the air inlet 115 to the air outlet 117. The channel 116 is preferably a hollow portion 116 as shown in FIG. 4*b*. A filter is preferably situated adjacent the toilet seat air inlet 115 to prevent debris from entering the toilet seat air inlet 115. The currently-preferred filter is a fabric cover that allows air to enter the toilet seat air inlet 115 and that is not odor-absorbent, though other filters may be used.

The air pump 120 has an inlet port 122 and an outlet port 124 (FIGS. 1 and 3*b*) and may be mounted on a bottom, side, front surface 12*a*, or rear surface 12*b* of a toilet tank 12. The pump 120 may also be mounted inside the tank 12 or simply on a floor surface behind the toilet 10. It is currently preferred to attach the pump 120 to the rear surface 12*b* of the tank 12 for aesthetics and installation and repair convenience, as shown in FIGS. 1, 3*a*, 3*b*, 5*a*, and 5*b*.

Figure 2:
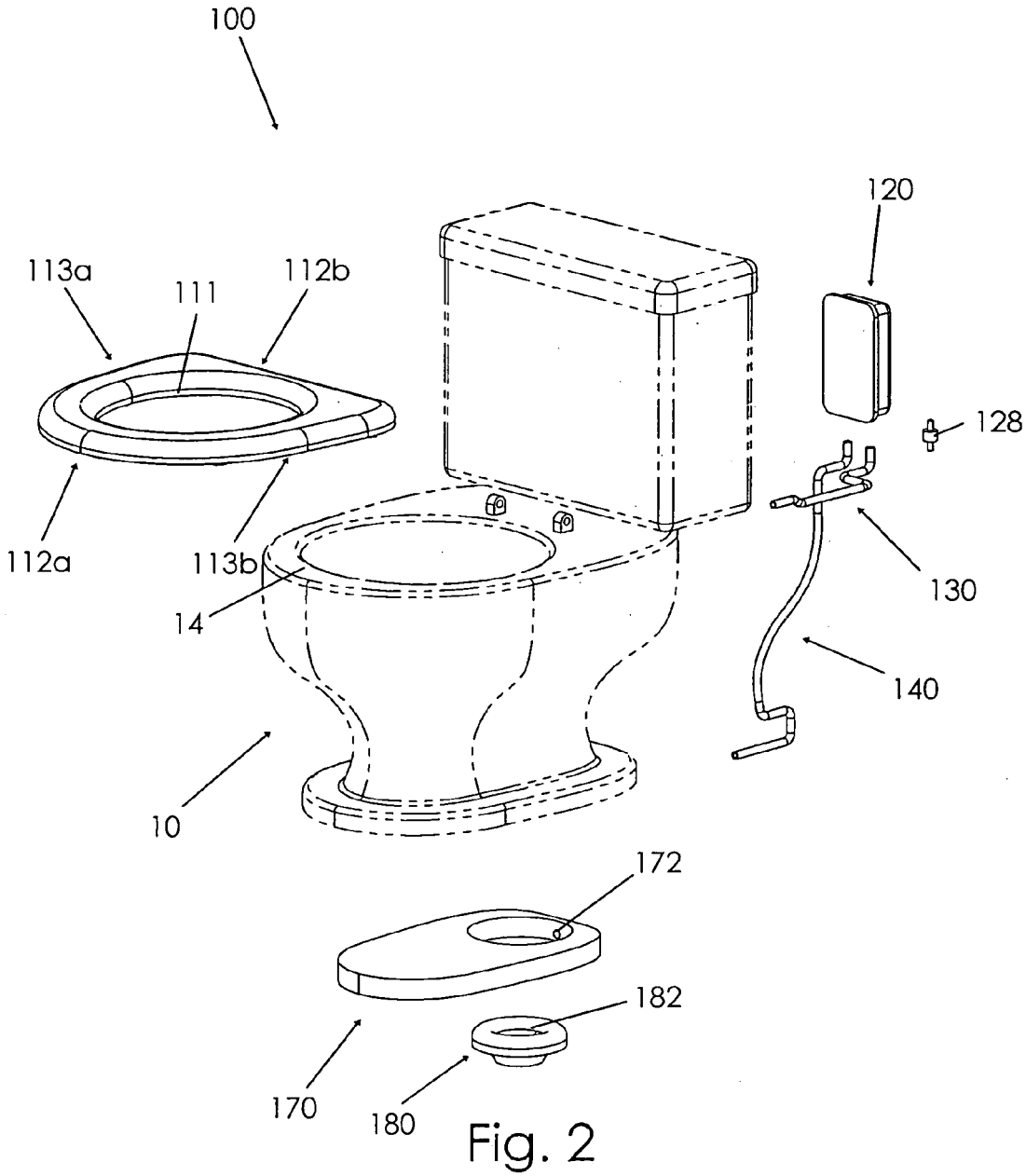
FIG. 2 is an exploded view of the system as in FIG. 1.
Figure 3A:
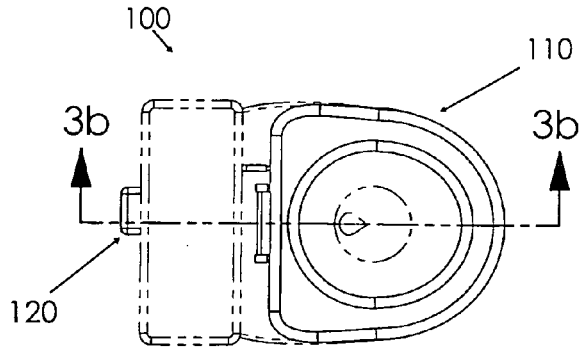
FIG. 3*a* is a top view of the system as in FIG. 1.
Figure 3B:
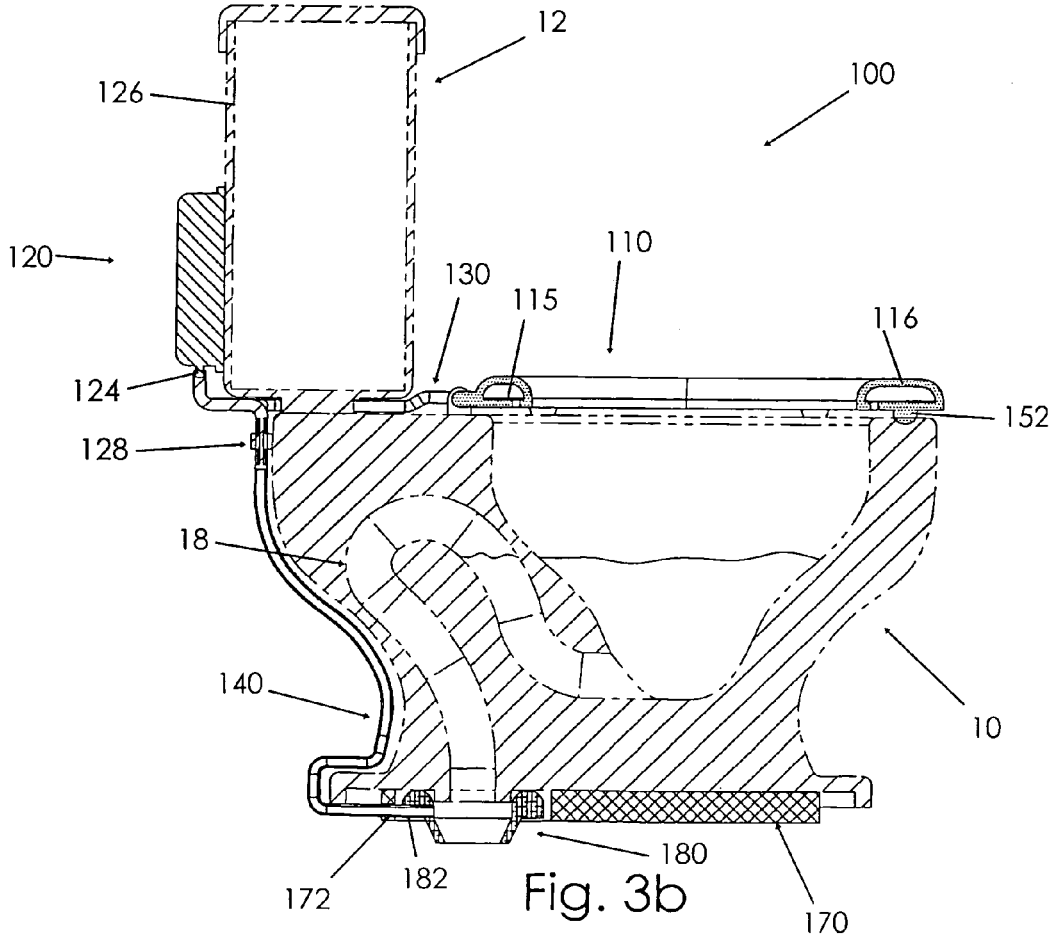
FIG. 3*b* is a sectional view of the system taken along line FIGS. 3*b*—3*b* of FIG. 3*a;*
Figure 5A:
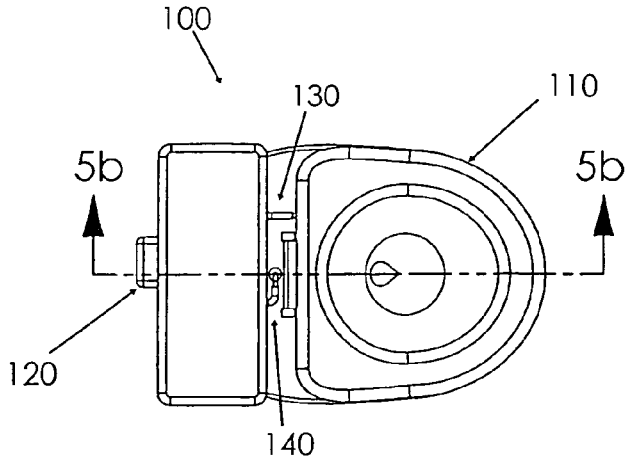
FIG. 5*a* is a top view of the system according to another embodiment of the present invention.

Tubing 130 preferably connects the seat air outlet 117 to the pump inlet port 122 to allow the pump 120 to draw air from the seat air inlet 115 to the pump inlet port 122 (FIG. 1), and additional tubing 140 operatively connects the pump outlet port 124 to the sewer line 20 (FIGS. 3*b* and 5*a*). A check valve 128 is preferably incorporated between the seat air outlet 117 and the sewer line 20 to prevent the backflow of sewer gases through the system 100 when the pump 120 is not operating (FIGS. 2 and 3*b*). The check valve 128 is preferably positioned in the additional tubing 140 between the pump outlet port 124 and the sewer line 20 to trap the sewer gases before they can reach the pump 120. The tubing 130 and the additional tubing 140 are preferably flexible plastic tubing, and a clip 160 having an adhesive material 162 for attaching to the toilet 10 and having a configuration complementary to a configuration of the tubing 130 or the additional tubing 140 may be included for attaching the tubing 130 or the additional tubing 140 to the toilet 10 (FIG. 1).

A switch 150 is in communication with the pump 120 to selectively actuate the pump 120 (FIG. 4*c*). Though many types of switches 150 may be used, an activation sensor 152 is preferably attached to the toilet seat bottom surface 114*b* for selectively interacting with a rim 14 of the toilet 10, as shown in FIGS. 1 and 4*c*. The activation sensor 152 is preferably a pressure switch that automatically actuates the pump 120 when a predetermined amount of pressure is applied to the toilet seat 110. The pressure switch 152 may include a delay so that the pump 120 continues to be actuated for a predetermined amount of time after the predetermined amount of pressure is no longer applied to the toilet seat 110. This delay would allow any odor that remains in the toilet 10 after the user leaves to be exhausted through the system 100. This could also be accomplished by programming the pump 120 to run for a predetermined amount of time after the switch 150 is released.

In a preferred embodiment, the system 100 includes a spacer 170 and a wax ring 180 (FIGS. 1 through 3*b*). The spacer 170 supports the toilet 10 and separates the toilet 10 from a floor surface. The spacer 170 defines a passageway 172 through which the additional tubing 140 extends (FIGS. 2 and 3*b*). The wax ring 180 is similar to a typical wax ring used to seal the toilet 10 to a floor flange, but the wax ring 180 defines a cavity 182 through which the additional tubing 140 extends (FIGS. 2 and 3*b*), allowing the air from the pump outlet port 124 to be exhausted into the sewer line 20 through the additional tubing 140. If the spacer 170 does not have a footprint that is as large as a footprint of the toilet 10, there will be a gap between the toilet 10 and the floor surface. Means for sealing the toilet 10 to the floor surface may be included to cover this gap, such as caulk or trim.

In use, the wax ring 180 is placed above the floor flange, and the spacer 170 is positioned about the wax ring 180, as shown in FIGS. 1 and 3*b*. The additional tubing 140 may be inserted through the spacer passageway 172 and through the wax ring cavity 182 so that one end of the additional tubing 140 is in communication with the sewer line 20 (FIG. 3*b*). The toilet may then be positioned upon the spacer 170 and connected to the wax ring 180 in a traditional manner. The caulk or trim may then be used to seal the toilet 10 to the floor surface, covering the gap between the toilet 10 and the floor surface caused by the spacer 170. The toilet seat 110 may be attached to the toilet 10 in a traditional manner, and the pump 120 may be positioned as desired. The pump 120 is preferably attached to the rear surface 12*b* of the tank 12. The tubing 130 may then be connected to the toilet seat air outlet 117 and to the air pump inlet port 122 (FIG. 1), and the additional tubing 140 may be connected to the air pump outlet port 124 (FIG. 3*b*). The tubing 130 and the additional tubing 140 may be secured to the toilet 10 by the clips 160 (FIG. 1).

When a sufficient amount of pressure is exerted upon the toilet seat 110, the sensor 152 actuates the air pump 120, which draws air from the toilet seat air inlets 115 to the air pump inlet port 122 and then pushes the air from the air pump outlet port 124 to the sewer line 20 through the additional tubing 140. The pump 120 may continue to operate for a predetermined amount of time after the pressure is removed from the toilet seat, depending on the switch 150 or the pump 120 as described above, in order to fully exhaust the odorous air. The check valve 128 prevents the backflow of sewer gases through the system 100 when the pump 120 is not operating.

Figure 5B:
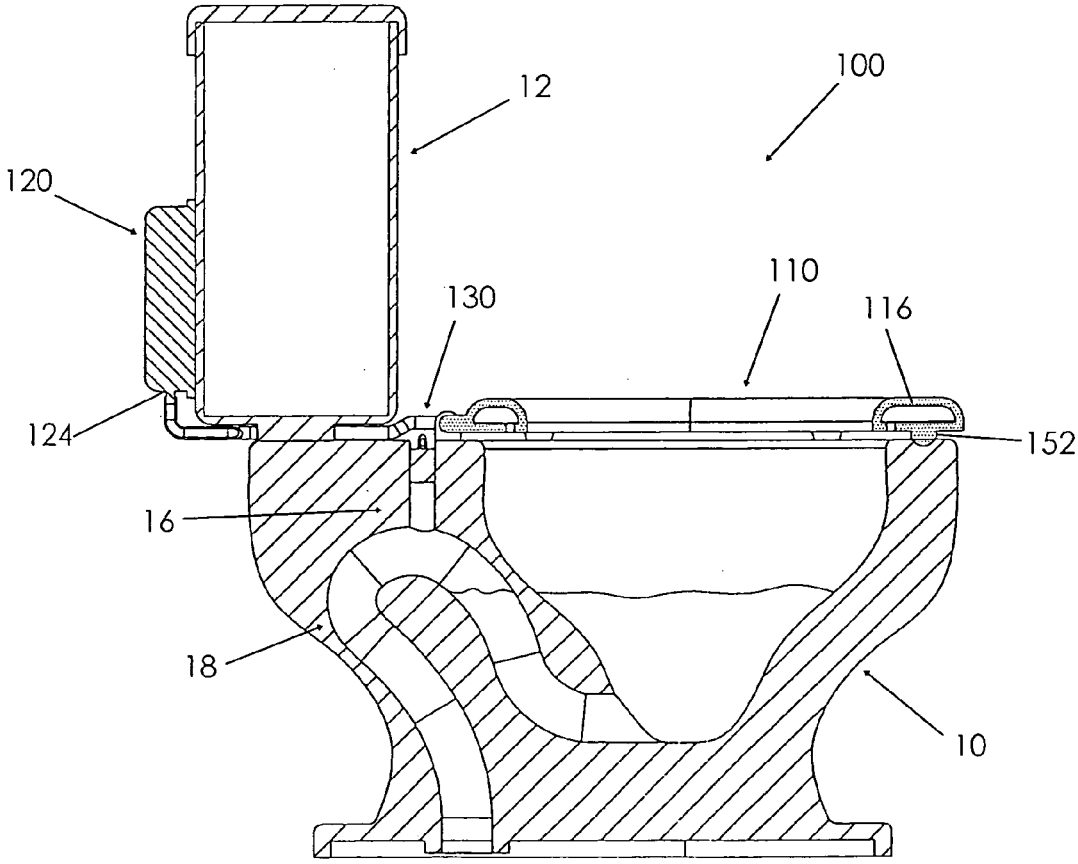
FIG. 5*b* is a sectional view taken along FIGS. 5*b*—5*b* of FIG. 5*a.*

In another embodiment shown in FIGS. 5*a* and 5*b*, the toilet 10 has a siphon tube 18 and an exterior surface 10*a* and defines an exhaust port 16 extending from the siphon tube 18 to the exterior surface 10*a*. The additional tubing 140 is operatively connected to the pump outlet port 124 and operatively connected to the siphon tube 18. Preferably, the additional tubing 140 extends from the pump outlet port 124 through the toilet exhaust port 16 and to the toilet siphon tube 18. In this embodiment, the check valve 128 is preferably positioned in the additional tubing 140 between the pump outlet port 124 and the toilet siphon tube 18. The exhaust port 16 may be built into the toilet 10 or may be drilled into an existing toilet 10 that was not manufactured with an exhaust port 16.

In use, the toilet seat 110 may be attached to the toilet 10 in a traditional manner, and the pump 120 may be positioned as desired. The tubing 130 may then be connected to the toilet seat air outlet 117 and to the air pump inlet port 122, and the additional tubing 140 may be connected to the air pump outlet port 124 and operatively connected to the siphon tube 18. The system 100 may then operate as described above.

It is understood that while certain forms of this invention have been illustrated and described, it is not limited thereto except insofar as such limitations are included in the following claims and allowable functional equivalents thereof.

What is claimed is:

1. A system for removing odor by exhausting air from a toilet into a sewer line, said system comprising:

a toilet seat presenting front and rear sides and top and bottom surfaces, said bottom surface defining an air inlet, an air outlet being adjacent said rear side, a channel between said top and bottom surfaces connecting said air inlet to said air outlet;

an air pump having an inlet port and an outlet port;

tubing connecting said seat air outlet to said pump inlet port for allowing the pump to draw air from said scat air inlet to said pump inlet port;

additional tubing operatively connecting said pump outlet port to the sewer line;

a spacer for supporting the toilet upon a floor surface and displacing the toilet therefrom, said spacer defining a passageway through which said additional tubing extends;

a wax ring for sealing the toilet to a floor flange, said wax ring defining a cavity through which said additional tubing extends.

2. The system as in claim 1, further comprising a check valve positioned in said additional tubing between said pump outlet port and the sewer line.

3. The system as in claim 1, further comprising means for sealing the toilet to the floor surface.

4. The system as in claim 1, wherein:

the toilet includes a siphon tube;

the toilet defines an exhaust port from said siphon tube to an exterior surface of the toilet; and said additional tubing extends from said pump outlet port through said toilet exhaust port to said toilet siphon tube.

5. The system as in claim 4, further comprising a check valve positioned in said additional tubing between said pump outlet port and said toilet siphon tube.

6. The system as in claim 1, wherein:

said toilet seat bottom surface defines a plurality of air inlets, said air inlets being positioned adjacent an inner edge of said seat;

said toilet seat presents opposed lateral sides, said air inlets being concentrated more densely adjacent said front and rear sides than adjacent said lateral sides.

7. The system as in claim 1, further comprising an activation sensor attached to said toilet seat bottom surface for selective interaction with a rim of the toilet.

8. The system as in claim 1, farther comprising a pressure switch attached to said toilet seat bottom surface for actuating said pump when a predetermined amount of pressure is applied to said toilet seat.

9. The system as in claim 8, wherein said pressure switch includes a delay so that said pump continues to be actuated for a predetermined amount of time after the predetermined amount of pressure is no longer applied to said toilet seat.

10. The system as in claim 1, further comprising a clip having an adhesive material for attaching to the toilet and having a configuration complementary to a configuration of said tubing for attaching to said tubing.

11. The system as in claim 1, wherein:

the toilet includes a tank having front and rear surfaces; and said pump is attached to the rear surface of the tank.

12. The system as in claim 1, wherein:

said tubing and said additional tubing are flexible plastic tubing.

13. A system for removing odor by exhausting air from a toilet having a siphon tube into a sewer line, said system comprising:

a toilet seat having front and rear sides and top and bottom surfaces and defining a hollow portion between said top and bottom surfaces, said bottom surface defining an air inlet, said toilet seat including an air outlet adjacent said rear side, and wherein said hollow portion connects said air inlet to said air outlet;

an air pump having an inlet port and an outlet port;

tubing connecting said seat air outlet to said pump inlet port for allowing said pump to draw air from said seat air inlet to said pump inlet port;

additional tubing operatively connecting said pump outlet port to the sewer line;

a spacer upon which the toilet is supported, whereby separating the toilet from a floor surface, said spacer defining a passageway through which said additional tubing extends;

a wax ring for sealing the toilet to a floor flange, said wax ring defining a cavity through which said additional tubing extends; and a check valve positioned in said additional tubing between said pump outlet port and the sewer line.

14. The system as in claim 13, wherein:

the toilet defines an exhaust port from the siphon tube to an exterior surface of the toilet; and the additional tubing is operatively connected to said pump outlet port and operatively connected to said siphon tube.

15. The system as in claim 13, further comprising a pressure switch connected to said toilet seat bottom surface for actuating said pump when a predetermined amount of pressure is applied to said toilet seat.

* * * * *